United States Patent [19]

Loesch et al.

[11] Patent Number: 5,031,432

[45] Date of Patent: Jul. 16, 1991

[54] PROCESS FOR THE ROLLING OF WIRE MATERIAL

[75] Inventors: Hans Loesch, Kapfenberg; Johann Eilmer; Franz Rischka, both of Bruck a. d. Mur, all of Austria

[73] Assignee: Boehler Gesellschaft m.b.H, Kapfenberg, Austria

[21] Appl. No.: 483,228

[22] Filed: Feb. 23, 1990

[30] Foreign Application Priority Data

Feb. 23, 1989 [AT] Austria ..... 404/89

[51] Int. Cl.[5] ..... B21B 37/10; B21B 39/18; B21B 1/16

[52] U.S. Cl. ..... 72/13; 72/202; 72/203

[58] Field of Search ..... 72/13, 14, 128, 131, 72/132, 200, 202, 203, 228

[56] References Cited

U.S. PATENT DOCUMENTS

| | | | |
|---|---|---|---|
| 379,974 | 3/1888 | Morgan | 72/202 |
| 4,176,535 | 12/1979 | Elsner et al. | 72/203 X |
| 4,866,967 | 9/1989 | Sporenberg et al. | 72/203 X |
| 4,891,963 | 1/1990 | Reumann | 72/203 |

FOREIGN PATENT DOCUMENTS

| | | |
|---|---|---|
| 0198153 | 1/1986 | European Pat. Off. . |
| 1502723 | 2/1963 | Fed. Rep. of Germany . |
| 227643 | 5/1963 | Fed. Rep. of Germany . |
| 2100088 | 7/1972 | Fed. Rep. of Germany . |
| 3730745 | 3/1988 | Fed. Rep. of Germany . |

*Primary Examiner*—E. Michael Combs

*Attorney, Agent, or Firm*—Fleit, Jacobson, Cohn, Price, Holman & Stern

[57] ABSTRACT

A process for rolling wire or rod material, such as hardenable steel, high speed steel and copper phosphorous alloys, includes feeding the material continuously from a supply roll through a heating zone and a rolling device for rolling the material in at least two stages, wherein the material at room temperature has a low deformation capacity unsuitable for rolling in the rolling device and therefore is heated in the heating zone to a temperature of improved deformation capacity suitable for rolling, the temperature of the material is continuously measured between the heating zone and the rolling device, a determination is made as to whether the material has been heated to a predetermined deformation temperature appropriate for rolling, diverting any portion of the material determined to have a temperature other than the appropriate rolling temperature away from the rolling device to prevent the diverted portion from entering the rolling device and being rolled, severing the diverted portion between the heating and rolling and directing the material determined to have been heated to the appropriate temperature the rolling device and rolling the material in at least two stages.

19 Claims, 2 Drawing Sheets

PROCESS FOR THE ROLLING OF WIRE MATERIAL

BACKGROUND OF THE INVENTION

1. Field of the Invention

The invention relates to a process for the rolling of wire or bar material, to which a reduction in cross-section is imparted by rolling devices in at least two successive rolling stages.

2. Description of the Prior Art

In this kind of process difficulties always arise when rolling stock at room temperature has a deficient deformation capacity or a too high deformation strength. When this kind of rolling stock is fed into the rolling device, hardening may occur in the first rolling stand such that the rolling stock inclines to brittle fracture or breakup or takes on a hardness such that rolling in the next stand is impaired or further deformation is impossible. The responsible factor here is represented particularly by fragments of the rolling stock, which, among other things, may adhere to the surface of the rolling stock and thus disadvantageously modify the thickness of the material fed into the following stands.

SUMMARY OF THE INVENTION

To avoid these disadvantages the inventive process — in the rolling of stock which at room temperature has a low deformation capacity or a high degree of brittleness and/or a high deformation strength, e.g. hardenable steels, high-speed steels, copper-phosphorus alloys, or the like provides that at the beginning of rolling the forward section of the rolling stock is heated and brought to a temperature that affords a better deformation capacity; that the forward section or under certain circumstances, the unheated or inadequately heated rolling stock located in the direction of removal and in front of the forward section, is diverted from the entrance of the rolling device, until temperature measurement ascertains that the deformation temperature of the rolling stock, which is heated in the heating zone, preferably by means of inductive or resistance heating, has been reached, whereupon the inadequately heated sections of the rolling stock or the sections not heated to the desired deformation temperature, specifically those sections located in direction of removal and in front of the adequately heated areas at the moment of measurement, are separated and only the rolling stock having deformation temperature is introduced into the rolling device. In this procedure care is taken to assure that those areas of the rolling stock which have a temperature beneath the desired deformation temperature and which are thus insufficiently rollable are not introduced into the rolling devices. Appropriate temperature measurement of the rolling stock, and separation of insufficiently heated stock (both upon intake and discharge) at that point at which the rolling stock achieves the desired deformation temperature, assure that only rolling stock with the desired deformation temperature is introduced into the rolling device.

Depending on how the process is conducted, provisions can be made to delay the removal or the motion of the rolling stock until the forward section reaches the desired deformation or rolling temperature. This method guarantees that only small sections of the rolling stock will have to be separated, since the front end of the rolling stock can almost entirely be brought to the desired deformation temperature in a heating zone.

It is advantageous if, after separation of the insufficiently heated rolling stock or the forward section, the separated portion is removed at a speed higher than the momentary speed of the rolling stock. This increased speed is advantageous in that it gains time needed to execute the deflection maneuver. The length of time available is determined by the interval required by the adequately heated rolling stock to cover the distance between separation and coupling.

In a preferred embodiment of the invention, when a drop in temperature in the rolling stock below the deformation temperature has been identified, particularly in the end area of the transported stock, the (end) section of the rolling stock having the lower temperature is separated before the rolling stock enters the rolling device. This method has a particular importance for the end area of the stock, which e.g. in a resistance heating zone may not be adequately heated due to lack of sufficient contact and which will consequently be removed in order not to damage the rolling devices.

In the case of steels it is advantageous to select a separation temperature below 400° C. and a deformation temperature of at most 1100° C., preferably 950° C., when necessary at most the ACI temperature or transformation temperature into the gamma structure of the alloy, or in the case of copper-phosphorus alloys, particularly with 5 to 15%, preferably about 10% of phosphorus, a separation temperature should be below 200° C., preferably below 180° C., particularly below 150° C.; a deformation temperature of 250° C., preferably 220° C. should not exceeded.

A device for the rolling of wire or bar material, to which a reduction in cross-section is imparted in two successive rolling stages, is characterized under the invention in that — in the rolling of stock that at room temperature possesses low deformation properties or brittleness and/or high deformation strength, e.g. hardenable steels, high-speed steels, copper-phosphorus alloys, or the like — a heating device, particularly an electric device for rapid heating, with energy introduced into the rolling stock through induction or direct current throughput, is positioned in front of rolling device, which comprises at least two levels and rolling frames in immediate succession; and in that a separating device for the rolling stock and a guidance device to selectively control the introduction of rolling stock into the rolling device or the diversion of the rolling stock from the rolling device are furnished between the rolling device and the heating device. This simply designed arrangement assures that areas of the rolling stock that have not been heated to the deformation temperature, i.e. front and back areas, can be precisely removed and damage to the rolling frames can be avoided.

An advantageous construction of this device results when the guidance device for an adjustment mechanism is adjustable, preferably tube-like guides with holes for the rolling stock, one of which can be directed to the roller opening of the rolling device and the other directed to a position that bypasses the rolling device. Rapid guidance of the rolling stock in the direction of the rolling device or past the latter can thereby be achieved.

In controlling the device it is advantageous to provide a control device which, as dependent on the temperature measured in the rolling stock by the temperature measuring device, allows the guidance device, the separating device, and under certain circumstances the temperature in the heating zone to be controlled or regulated. Provision can also be made to assure that at least one device for measuring the temperature of the rolling stock is positioned behind the heating device, by means of which the activity of the separating device may be controlled. In the same fashion provision can be made to assure that the adjusting or guidance device is controlled by the temperature measuring device. As dependent on the temperature of the rolling stock, the individual devices can be controlled either automatically or manually. At the same time, the appropriate regulation of temperature in the heating zone provides for the proper heating of the rolling stock.

Further preferred embodiments of the invention emerge from the following description, the patent claims, and the diagrams.

BRIEF DESCRIPTION OF THE DRAWING

The invention is described below in greater detail on the basis of the diagrams.

DESCRIPTION OF THE PREFERRED EMBODIMENTS

Figure 1:
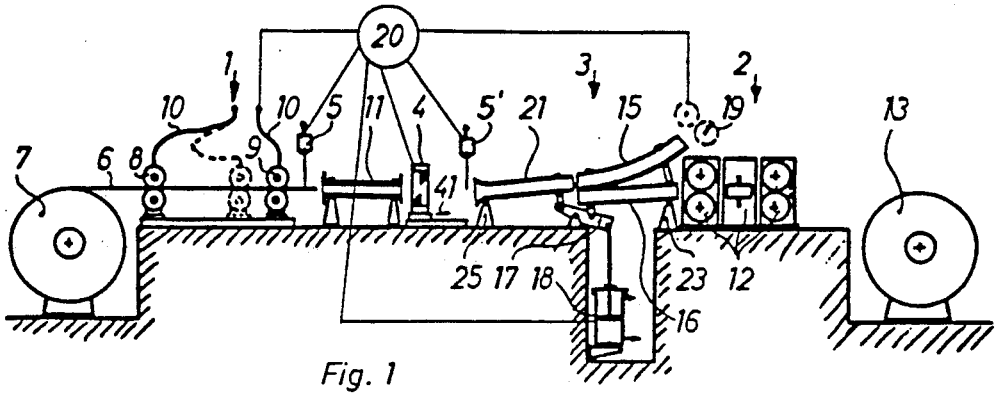
FIGS. 1, 1*a*, and 1*b* show an initial embodiment of the inventive device in various stages of operation.

FIG. 1 shows an initial embodiment of the inventive device. A stock to be rolled 6, which in the present case is wire material, is drawn off from a drum 7. The rolling stock 6 is heated in a heating zone 1 by means of contact rolls 8 and 9 and resistance heating; the contact rolls 8 and 9 are attached to a current source by way of lines 10. The contact roll 8 is adjustable relative to its distance from contact roll 9, as indicated by the broken lines; this assures different heating speeds and accommodates different wire materials. The front end of the rolling stock 6 is located in the vicinity of a first temperature measuring device 5, e.g. a thermo-sensor, which continuously measures the temperature of the rolling stock 6. Numeral 11 designates a compensator, in which temperature equalization of the rolling stock 6 or supplementary heating is performed. The rolling stock 6 (FIG. 1*a*) is then passed through a separating device 4, which is the present case in represented by guillotine shears. The separating device 4 can be moved in the direction of arrow 41 and at the same speed as the advancing motion of the rolling stock, so as not to impede the rolling stock 6 upon separation of the latter. A further temperature measuring device 5' is provided in order to measure the rolling stock 6 before it enters a guidance device 3 with guide element 21; the guide element 21 is swivel-mounted at its end on a mount 25. The outlet of guide unit 21 can be aligned with either of two guides 15, 16, e.g. tubes. The two guides 15, 16 are swivel-mounted on a pivoted lever 17, which assures that the outlet end of guide unit 21 is aligned with one of the two openings of guides 15, 16; the lever 17 is adjusted by means of e.g. an hydraulic or pneumatic adjustment device 18, which in the present case is mounted below the lever 17 and engages with the end area of the lever. The outlet end of the guide tube 16 leading to the rolling device is swivel-mounted on a mount 23. The guide tubes 15, 16 are also connected in the end outlet areas in order to permit them to jointly execute their motion. The guide tube 15 bends away from the rolling device 2 and is directed toward a pair of rollers 19 for removal of the rolling stock 6. The rolling device 2 comprises several, i.e. at least two, rolling stands 12, which are positioned in immediate succession and impart the proper cross-sectional reduction to the rolling stock 6. A drum 13 serves to wind the reduced rolling stock 6.

Figure 1A:
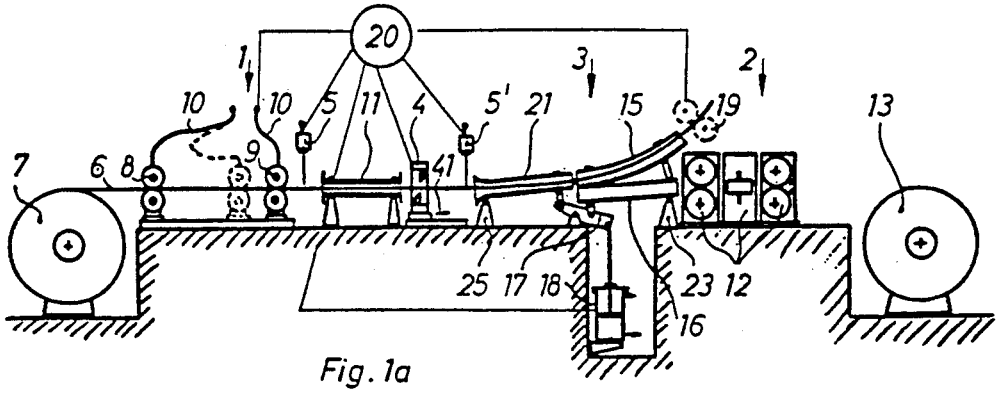

In FIG. 1 the arrangement of guide element 21 and guides 15, 16 is such that the rolling stock 6, which is at first insufficiently heated and enters guide element 21, is directed through guide 15 to the roller pair 19 for removal. This position is also shown in FIG. 1*a*, where the rolling stock 6 to be separated has already been introduced into rollers 19.

Upon movement of the rolling stock 6 from the position shown in FIG. 1, the rolling stock 6 is heated in the heating zone and its temperature is measured by means of temperature measuring device 5 and/or 5'. The measured values can either be read off and the separating device 4 is operated manually, or — more effectively — a control device 20 can be provided for controlling the individual devices. If the temperature measuring devices 5, 5' ascertain that the temperature of the rolling stock 6, upon leaving the heating zone 1 and/or before entering the guide unit 21, has achieved a sufficient deformation temperature, the insufficiently heated forward section of the rolling stock 6 is separated by means of separating device 4. The position, i.e. the moment in time of cutting, is determined by the control device 20, and preferably is as close as possible to the border of the area in which the desired temperature has been reached, in order to thereby minimize rolling stock waste. The new front end of the rolling stock 6, which was created by the cutting and which displays the desired deformation temperature, is then introduced directly into the rolling device 2.

The feeding speed of the rolling stock is at least 0.2 m/s and preferably at least 0.5 m/s.

Figure 1B:
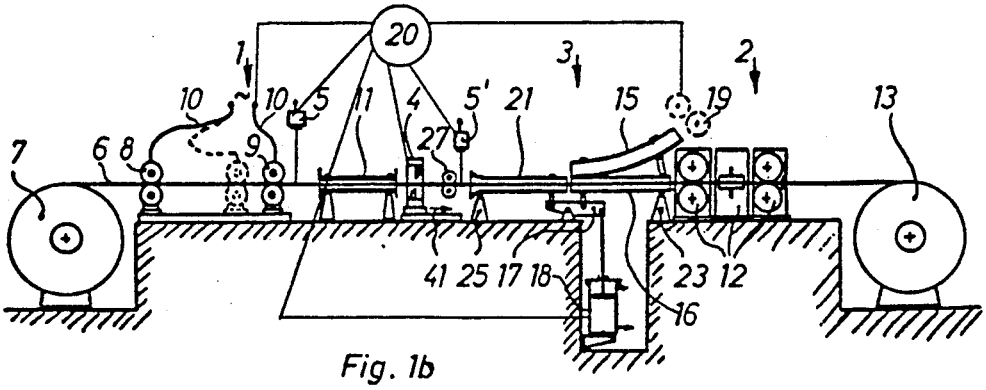

At the moment at which cutting is completed the removal rollers 19 are raised to a higher speed in order to allow sufficient time for the repositioning of guide unit 21 and of guides 15 and 16 into the position shown in FIG. 1*b* — in which the guide element 21 is directed toward guide 16 pointing to the rolling device. In the depicted embodiment, guide unit 21 and the guides 15, 16 are shown simultaneously in adjustment or alignment.

A similar procedure occurs in the back end area of the rolling stock 6. At the moment at which the back area end of the rolling stock 6 leaves contact with the first contact roll 8 in the heating zone 1, this area of the rolling stock is no longer heated and its temperature drops to a range below the desired deformation temperature. This area is recaped by the temperature measuring device 5, and the back end section of the rolling stock is separated in front of this area by the separating device 4. Repositioning of the guidance device formed by guide element 21 and tubes 15, 16 is not absolutely necessary in this case, since the back end section of the rolling stock — when no longer driven — remains at rest, while the sufficiently heated rolling stock 6 is drawn through the rolling device 2 and is coiled on drum 13. If the unheated end section of rolling stock 6 is sufficiently long, it can be guided into the removal rollers 19 by means of a drive roller unit 27 (FIG. 1*b*) and removed, while the guidance device is simultaneously repositioned.

Figure 2:
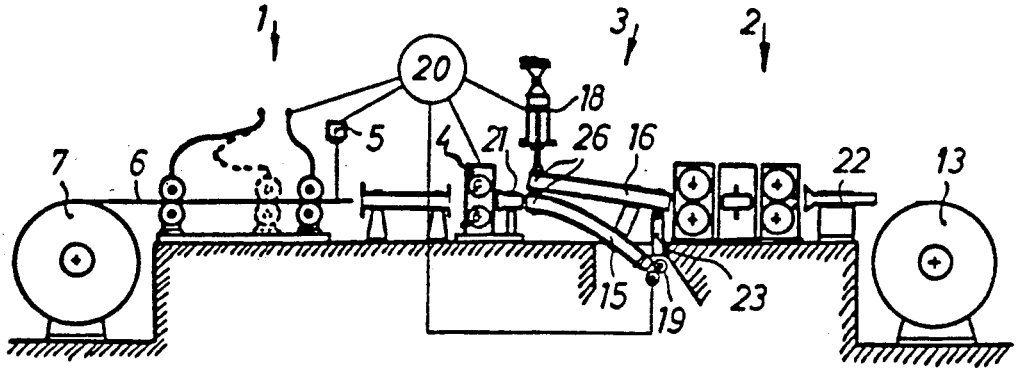
FIGS. 2, 2*a*, and 2*b* show a second embodiment of the inventive device, likewise in various stages of operation.

FIG. 2 shows another embodiment of the inventive device, which differs mainly in the design of the guidance device 3. A locally fixed, unmovable guide unit 21 is positioned behind the separating device 4, in relation to which the openings 26 of guides (tubes) 15, 16 can be directed by means of the adjustment device 18. The tube 15 curves away from rolling device 2 and is directed at the removal rollers 19, while the tube 16 leads into the rolling device 2. As regulated by the control device 20, the adjustment device 18 repositions one of openings 26 of tubes 15, 16 in front of guide unit 21, depending on whether the approaching rolling stock 6 is to be eliminated or directed to the rolling device 2. Furthermore, a guide 22 is positioned behind the rolling device 2 and leads to the drum 13. The guide 16 is swivel-mounted on mount 23 and is attached in fixed fashion to the other guide 15.

Figure 2A:
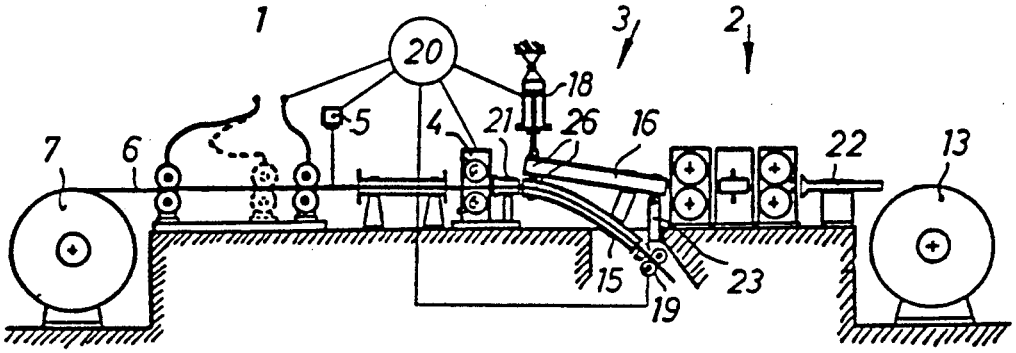
Figure 2B:
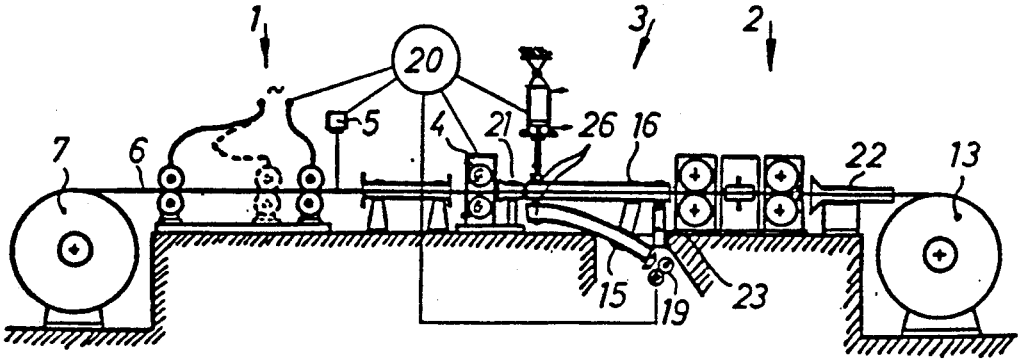

FIG. 2. shows the startup position, FIG. 2*a* the position in which the forward section of rolling stock 6 is diverted from the rolling device 6, and FIG. 2*b* shows the inventive device in rolling operation, in which the rolling stock 6 with the desired deformation temperature is directed into the rolling device 2.

In FIGS. 2, 2*a*, and 2*b*, the separating device is represented by rotating shears, which in the present case do not move in conjunction with the rolling stock 6. Furthermore, only one temperature measuring device is furnished or, as the case may be, the temperature measuring device 5', which serves only as a control function, has been omitted.

It is also possible to provide an adjustment device for each of guides 15, 16, with corresponding coordination of the guide movements; in this case each of the guides can be adjusted independent of the other.

It must be noted that the heating zone can be any kind of means known to the prior art. Likewise, the rolling devices are of a design known to the prior art.

What we claim is:

1. A process for rolling wire or rod material selected form the group consisting of hardenable steel, high-speed steel and copper-phosphorous alloys comprising:
   providing a length of said material to be rolled having a forward end section of low deformation capacity at room temperature;
   providing a heating zone for heating said material;
   providing a rolling device for rolling said material downstream of said heating zone;
   feeding said material through said heating zone and rolling device;
   heating said material in said heating zone to a temperature of improved deformation capacity;
   continuously measuring the temperature of said material between said heating zone and said rolling devices and determining whether said material has been heated to a predetermined deformation temperature appropriate for rolling;
   diverting any portion of said material determined to have a temperature other than said predetermined deformation temperature between said heating and said rolling away from said rolling device to prevent said diverted portion from entering said rolling device and being rolled;
   severing said diverted portion between said heating and said rolling; and
   directing said material determined to have been heated to said predetermined deformation temperature to said rolling device and rolling said material in at least two stages therein.

2. The process as claimed in claim 1 wherein:
   said material comprises steel; and
   said predetermined deformation temperature is in the range of 400° C. to 1100° C.

3. The process as claimed in claim 34 wherein:
   said predetermined deformation temperature has a maximum value of 950° C.

4. The process as claimed in claim 1 wherein:
   said material comprises steel;
   said predetermined deformation temperature has a maximum value substantially corresponding to the transformation temperature into the gamma structure of the alloy.

5. The process as claimed in claim 1 wherein:
   said material comprises a copper-phosphorus alloy; and
   said predetermined deformation temperature is in the range of 180° C. to 250° C.

6. The process as claimed in claim 5 wherein:
   said predetermined deformation temperature has a maximum value of 220° C.

7. The process as claimed in claim 1 and further comprising:
   heating said forward end section prior to said feeding thereof.

8. The process as claimed in claim 1 and further comprising:
   feeding said material at a predetermined feeding speed; and
   moving said diverted severed portion at a greater speed than said predetermined feeding speed.

9. The process as claimed in claim 5 wherein:
   said phosphorous content of said alloy is in the range of 5 to 15%.

10. The process as claimed in claim 9 wherein:
   said phosphorous content is substantially 10%.

11. The process as claimed in claim 1 and further comprising:
   rolling said material to a reduction in cross-section thereof of at least 40%.

12. The process as claimed in claim 8 wherein:
   said feeding speed is at least 0.2 m/s.

13. The process as claimed in claim 12 wherein:
   said feeding speed is at least 0.5 m/s.

14. The process as claimed in claim 1 wherein:
   said temperature measuring comprises measuring the temperature of said material at two spaced positions.

15. The process as claimed in claim 2 and further comprising:
   heating said forward end section prior to said feeding thereof.

16. The process as claimed in claim 15 and further comprising:
   feeding said material at a predetermined feeding speed; and
   moving said diverted severed portion at a greater speed than said predetermined feeding speed.

17. The process as claimed in claim 16 and further comprising:
   rolling said material to a reduction in cross-section thereof of at least 40%.

18. The process as claimed in claim 17 wherein:
   said feeding speed is at least 0.5 m/s.

19. The process as claimed in claim 18 wherein:
   said temperature measuring comprises measuring the temperature of said material at two spaced positions.

* * * * *